US008187018B2

(12) United States Patent
Kosugi

(10) Patent No.: US 8,187,018 B2
(45) Date of Patent: May 29, 2012

(54) CONNECTOR AND CONNECTING UNIT

(75) Inventor: Naofumi Kosugi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/064,572

(22) Filed: Mar. 31, 2011

(65) Prior Publication Data

US 2011/0183541 A1 Jul. 28, 2011

Related U.S. Application Data

(63) Continuation of application No. PCT/JP2008/067806, filed on Oct. 1, 2008.

(51) Int. Cl.
*H01R 4/50* (2006.01)

(52) U.S. Cl. ..... 439/344

(58) Field of Classification Search ..... 439/344, 439/352, 354
See application file for complete search history.

(56) References Cited

U.S. PATENT DOCUMENTS

| | | | | |
|---|---|---|---|---|
| 6,447,170 | B1 | 9/2002 | Takahashi et al. | |
| 7,052,186 | B1 * | 5/2006 | Bates | 385/59 |
| 2003/0220008 | A1 | 11/2003 | Viklund et al. | |
| 2005/0124201 | A1 | 6/2005 | Lo et al. | |
| 2006/0134963 | A1 | 6/2006 | Lo et al. | |
| 2006/0199414 | A1 * | 9/2006 | Larkin | 439/344 |
| 2007/0298636 | A1 | 12/2007 | Kusuda et al. | |

FOREIGN PATENT DOCUMENTS

| | | |
|---|---|---|
| JP | 05-152030 | 6/1993 |
| JP | 08-273749 | 10/1996 |
| JP | 2001-015212 | 1/2001 |
| JP | 2005-235545 | 9/2005 |
| JP | 2006-011102 | 1/2006 |
| JP | 2006-134858 | 5/2006 |
| JP | 2006-526262 | 11/2006 |
| JP | 2006-344410 | 12/2006 |
| JP | 2008-010210 | 1/2008 |
| JP | 3144788 | 8/2008 |

OTHER PUBLICATIONS

International Search Report for PCT/JP2008/067806, Mailed Oct. 28, 2008.

* cited by examiner

*Primary Examiner* — Phuong Dinh
(74) *Attorney, Agent, or Firm* — Staas & Halsey LLP

(57) ABSTRACT

A connector includes a connector protrusion to be inserted into a connector socket and including a locking lever provided on a first surface and a connecting terminal provided on a second surface opposing the first surface or on a front surface; and a connector frame surrounding the connector protrusion and having an opening in a surface opposing the first surface of the connector protrusion. When the connector frame is moved in a direction opposite to the direction where the connector protrusion is inserted while the connector protrusion is in the connector socket, an end of the locking lever fits into the opening and the locking lever is unlocked.

7 Claims, 21 Drawing Sheets

CONNECTOR AND CONNECTING UNIT

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2008/067806, filed on Oct. 1, 2008, the entire contents of which are incorporated herein by reference.

FIELD

The embodiments discussed herein are related to a connector and a connecting unit that make it easier to unplug a LAN (Local Area Network) cable from a PCI (Peripheral Component Interconnect) card.

BACKGROUND

PCI hot-swap cassettes (or cartridges) are becoming widely used as a hot-swapping technology for PCI cards. With this technology, a PCI card is placed in a PCI hot-swap cassette and the PCI hot-swap cassette is mounted in a computer or an information processing apparatus. As illustrated in FIG. 22(*a*), due to the configuration of the PCI hot-swap cassette, a front plate of the PCI card is recessed from the surface of the computer.

The recess is generally very narrow as illustrated in FIG. 22(*b*) and it is difficult to unplug a LAN cable connected to the PCI card with fingers. Therefore, to unplug the LAN cable for maintenance, it is necessary to press down a release clip (or lever) for unlocking a LAN connector of the LAN cable with a tool such as a flat-head screwdriver.

FIG. 23 illustrates a related-art LAN cable connected to a PCI card. As is apparent from FIG. 23, the release clip is short and it is difficult to unlock the LAN connector only with fingers.

Here, a related-art document discloses an actuator that makes it easier to put a plug in and out of a socket. Another related-art document discloses a modular plug having a lever for unlocking the modular plug to pull out the modular plug from a connector. The disclosed technology makes it easier to pull out the modular plug from the connector and also makes it possible to reduce the size and thickness of the connector.

Another related-art document discloses a connector with an attaching/detaching mechanism that makes it possible to reduce the size of the connector and to improve the reliability and operability of the connector. Still another related-art document discloses a plug connecting part including a sliding sleeve that is operated to move a locking part to an unlock position to unlock the plug connecting part.

[Patent document 1] Japanese Laid-Open Patent Publication No. 2006-134858

[Patent document 2] Japanese Laid-Open Patent Publication No. 2008-10210

[Patent document 3] Japanese Laid-Open Patent Publication No. 2005-235545

[Patent document 4] Japanese Laid-Open Publication No. 2006-526262

However, using a tool such as a flat-head screwdriver to unlock a LAN connector is bothersome and if the user drops such a tool, it may damage an apparatus. Also, if a LAN cable is connected to the back side of a computer and the back side of the computer faces a wall of a machine room, it may be necessary to physically move the computer away from the wall.

Further, when multiple PCI cards are placed in a PCI hot-swap cassette and multiple cables are plugged into the PCI cards, it is difficult to unplug a particular one of the cables with fingers.

SUMMARY

According to an aspect of the invention, there is provided a connector that includes a connector protrusion to be inserted into a connector socket and including a locking lever provided on a first surface and a connecting terminal provided on a second surface opposing the first surface or on a front surface; and a connector frame surrounding the connector protrusion and having an opening in a surface opposing the first surface of the connector protrusion. The connector frame is configured such that when the connector frame is moved in a direction opposite to the direction where the connector protrusion is inserted while the connector protrusion is in the connector socket, an end of the locking lever fits into the opening and the locking lever is unlocked.

The object and advantages of the invention will be realized and attained by means of the elements and combinations particularly pointed out in the claims.

It is to be understood that both the foregoing general description and the followed detailed description are exemplary and explanatory and are not restrictive of the invention, as claimed.

DESCRIPTION OF EMBODIMENTS

<First Embodiment>

Figure 1:
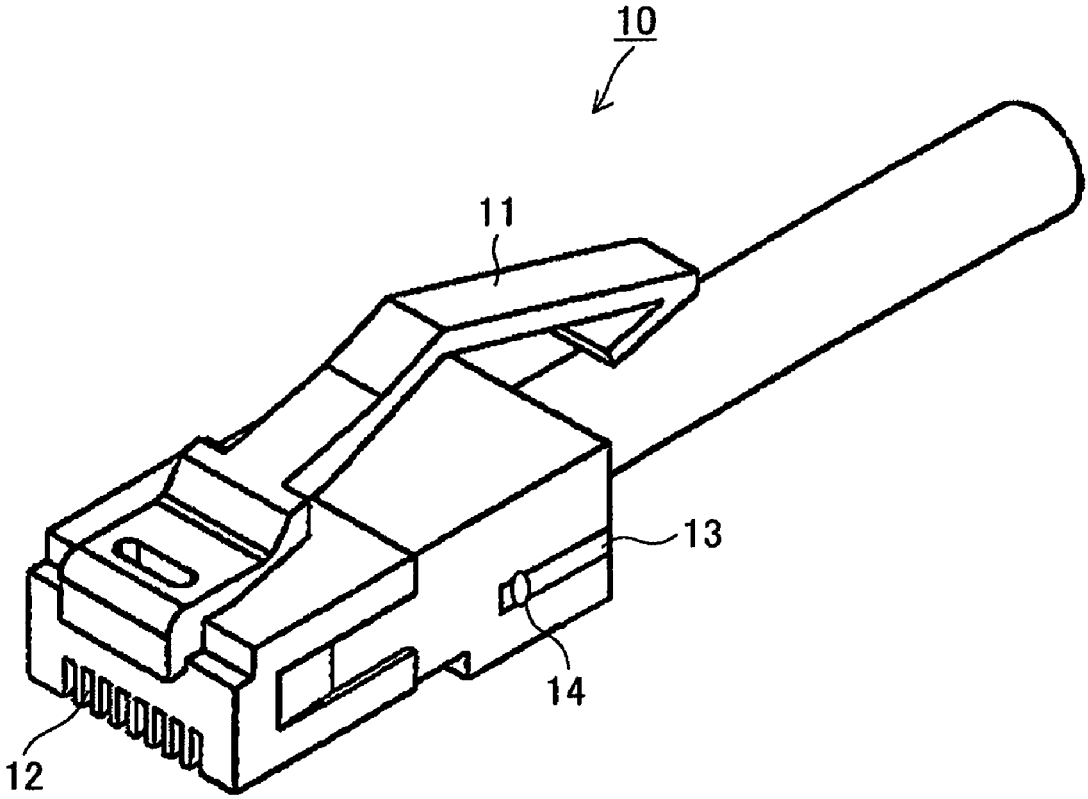
FIG. 1 is a perspective view of an exemplary modular plug according to a first embodiment.
Figure 2:
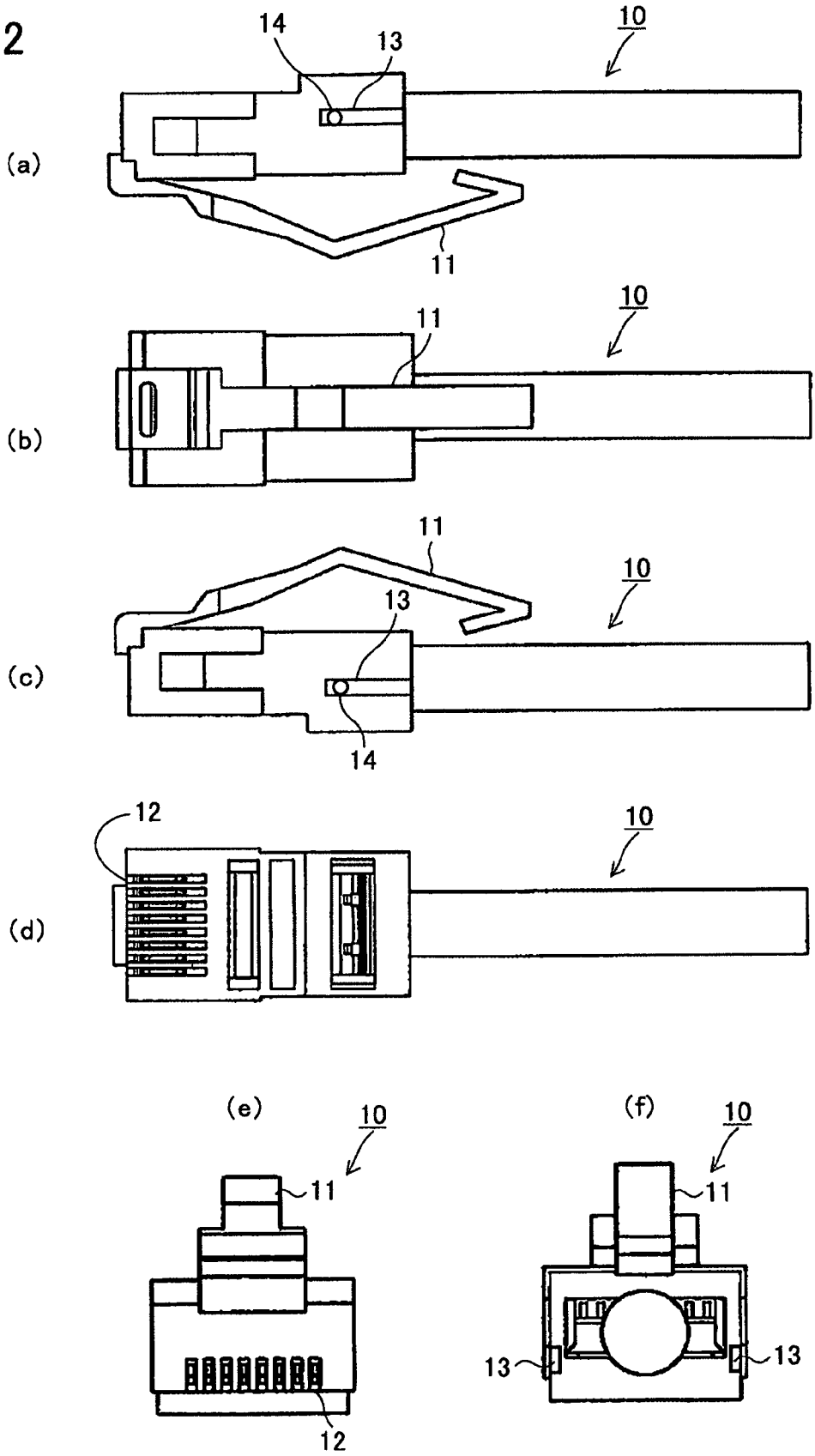
FIGS. 2(*a*) through 2(*f*) are drawings illustrating six sides of an exemplary modular plug according to the first embodiment.

A first embodiment of the present invention is described below with reference to the accompanying drawings. FIG. 1 is a perspective view of a modular plug 10 for a LAN cable according to the first embodiment. FIGS. 2(*a*) through 2(*f*) are drawings illustrating six sides of the modular plug 10. FIG. 2(*a*) is a left side view, FIG. 2(*b*) is a plan view, FIG. 2(*c*) is a right side view, FIG. 2(*d*) is a bottom view, FIG. 2(*e*) is a front view, and FIG. 2(*f*) is a rear view of the modular plug 10. In FIGS. 1 through 2(*f*), the same reference number indicates the same component.

The modular plug 10 (connector protrusion) includes a locking lever 11, connecting terminals 12 (first connecting terminals), grooves 13, and dowel housings 14.

One end of the locking lever 11 is fixed to a surface (first surface) of the modular plug 10. The other end of the locking lever 11 is bent at an acute angle to form a hook-like shape and a middle part of the locking lever 11 is bent at an obtuse angle. Similar to a release clip of a related-art LAN modular plug, the locking lever 11 has elasticity. When no force is applied to the locking lever 11, the locking lever 11 is in a locking position where the modular plug 10 engages (or is interlocked with) a PCI card (hereafter called a LAN board). When a downward force (toward the LAN cable) is applied to the middle part of the locking lever 11, the modular plug 10 is unlocked and released from the LAN board.

Like a related-art LAN modular plug, the connecting terminals 12 are connected with a twisted-pair cable with 8 cores (4 pairs) and used for electric communications between the modular plug 10 and the LAN board.

The grooves 13 are U-shaped grooves. Assuming that a surface of the modular plug 10 where the connecting terminals 12 are arranged is the front surface, the grooves 13 are formed in the right and left side surfaces of the modular plug 10. An unlocking mechanism 20 described later engages and slides along the grooves 13.

The dowel housings 14 are for housing dowels 22 of the unlocking mechanism 20 and have a cup shape that fits a dorm shape of the dowels 22.

Figure 3:
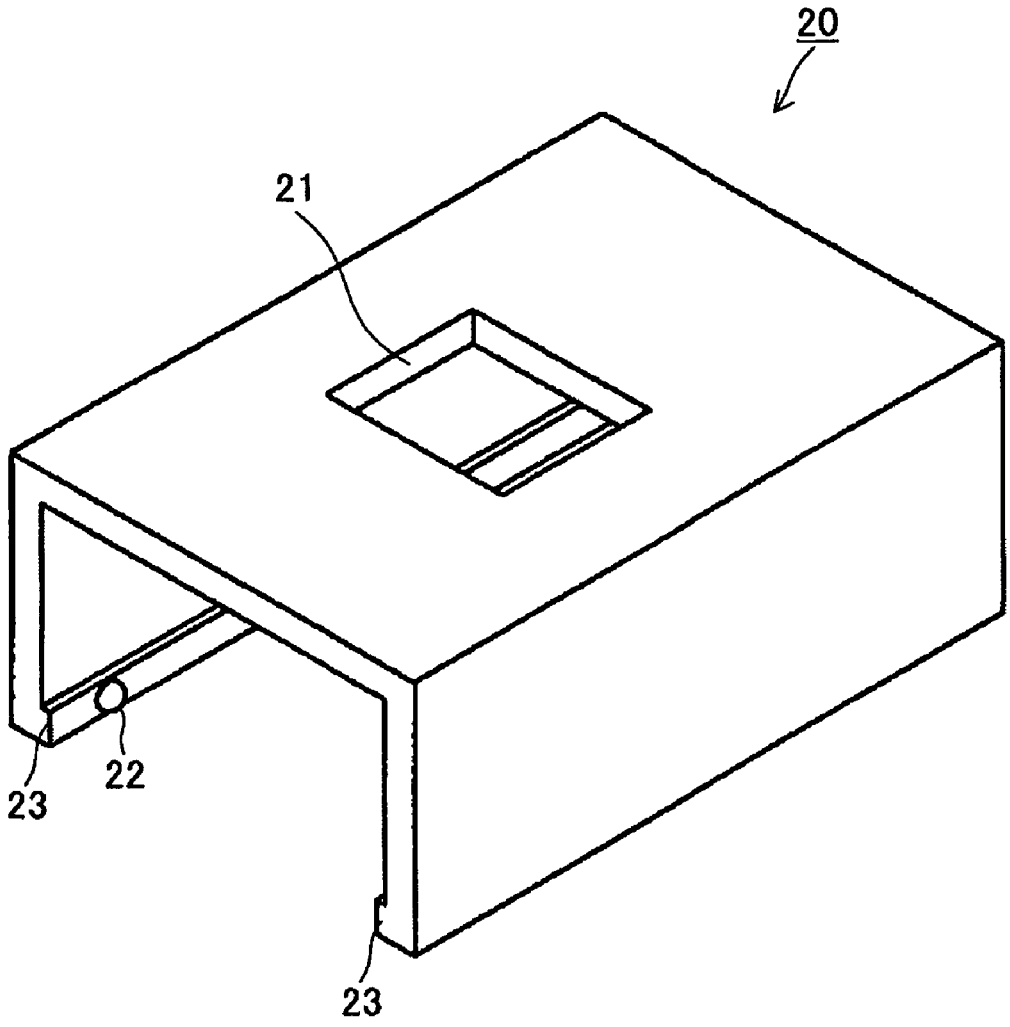
FIG. 3 is a perspective view of an exemplary unlocking mechanism according to the first embodiment.
Figure 4:
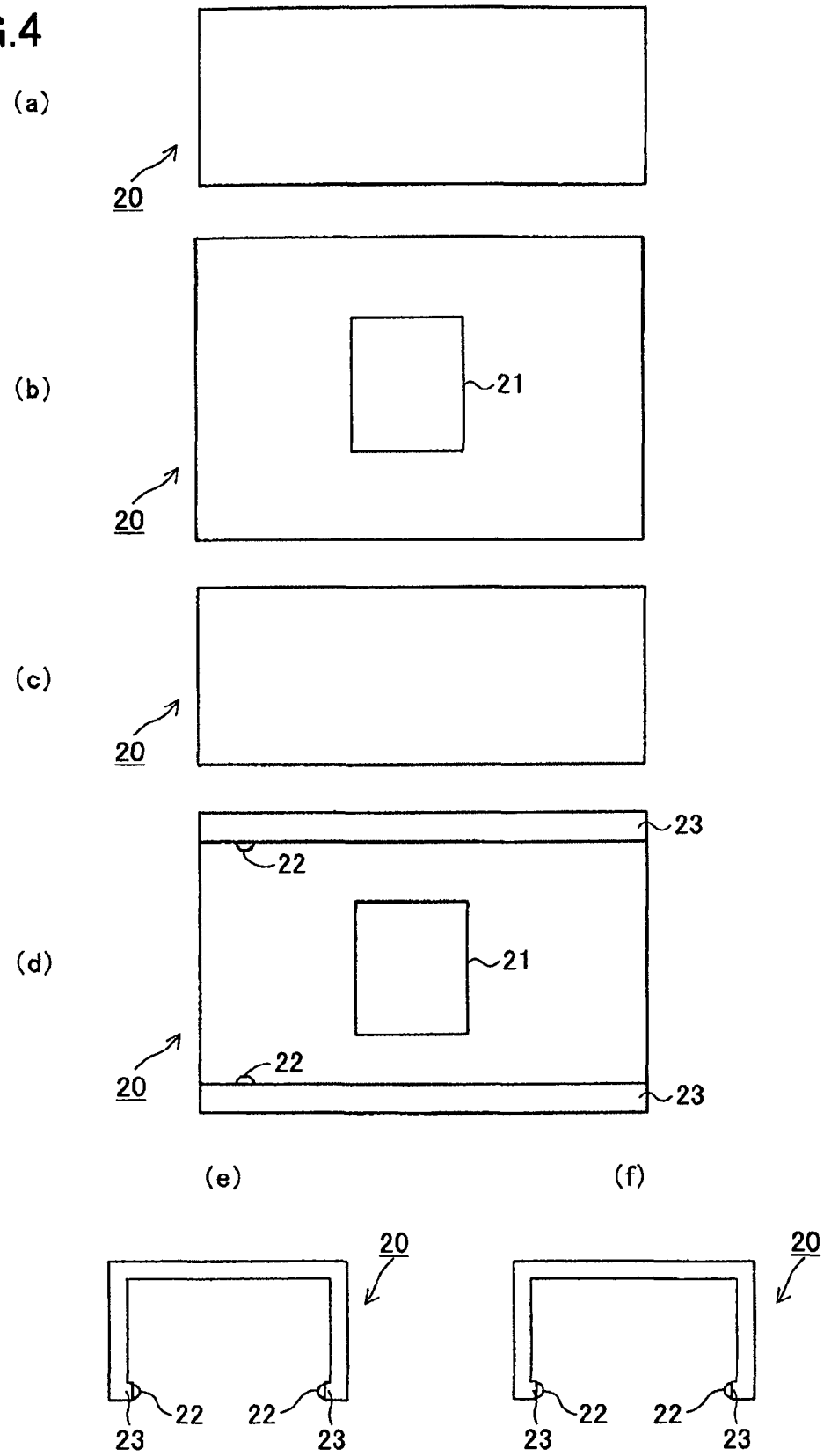
FIGS. 4(*a*) through 4(*f*) are drawings illustrating six sides of an exemplary unlocking mechanism according to the first embodiment.

FIG. 3 is a perspective view of the unlocking mechanism 20 according to the first embodiment. FIGS. 4(*a*) through 4(*f*) are drawings illustrating six sides of the unlocking mechanism 20. FIG. 4(*a*) is a left side view, FIG. 4(*b*) is a plan view, FIG. 4(*c*) is a right side view, FIG. 4(*d*) is a bottom view, FIG. 4(*e*) is a front view, and FIG. 4(*f*) is a rear view of the unlocking mechanism 20. In FIGS. 3 through 4(*f*), the same reference number indicates the same component.

The unlocking mechanism 20 (connector frame) has a U-like shape surrounding the modular plug 10. The unlocking mechanism 20 includes an opening 21, the dowels 22, and engaging parts 23.

The opening 21 is formed in a surface of the locking mechanism 20 that opposes the surface of the modular plug 10 to which the locking lever 11 is fixed. The hook-shaped end of the locking lever 11 is to fit into the opening 21.

The engaging parts 23 engage the grooves 13 to allow the unlocking mechanism 20 to slide over the modular plug 10. The engaging parts 13 are formed by bending the ends of right-side and left-side walls of the unlocking mechanism 20 inward at 90 degrees.

The dowels 22 limit the sliding movement of the unlocking mechanism 20 with respect to the modular plug 10. The dowels 22 protrude from the engaging parts 23 and have a dorm shape. The dowels 22 fit in the dowel housings 14 and thereby limit the sliding movement of the unlocking mechanism 20.

Figure 5:
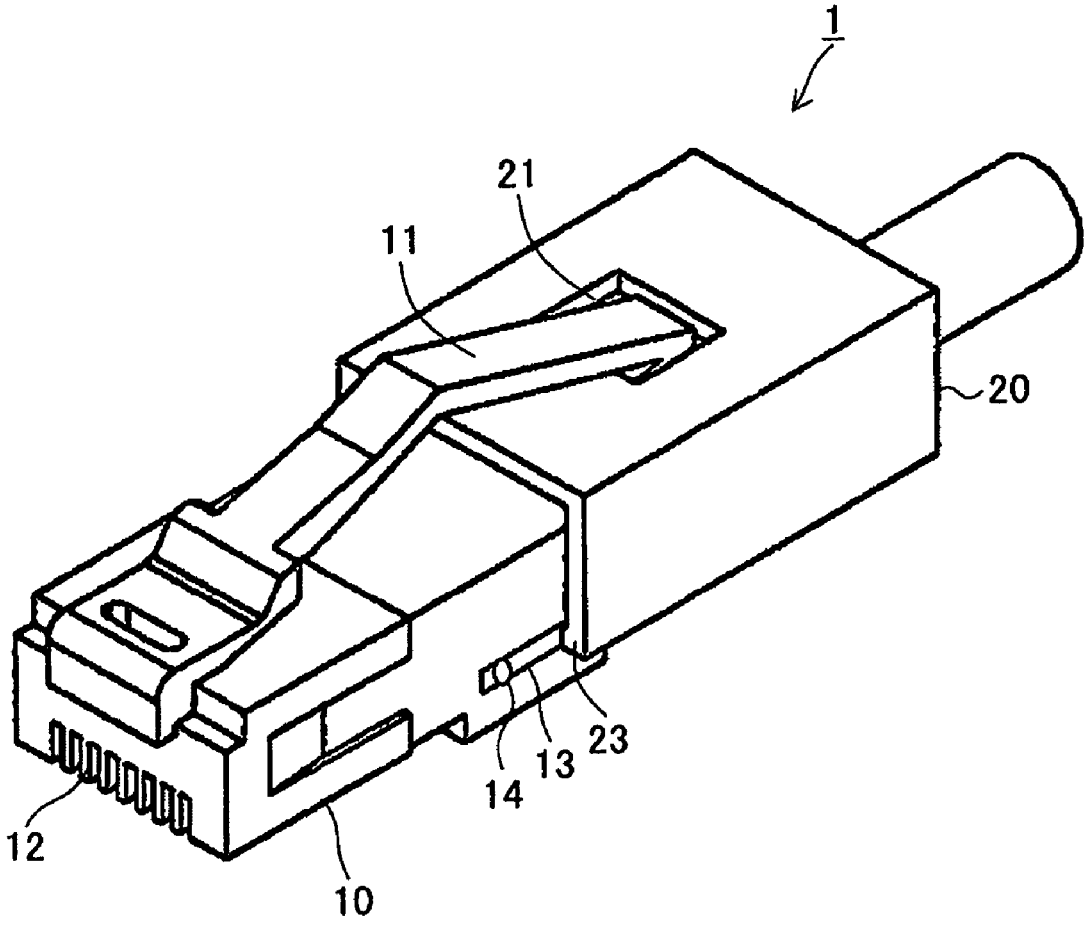
FIG. 5 is a perspective view of an exemplary LAN connector according to the first embodiment.
Figure 6:
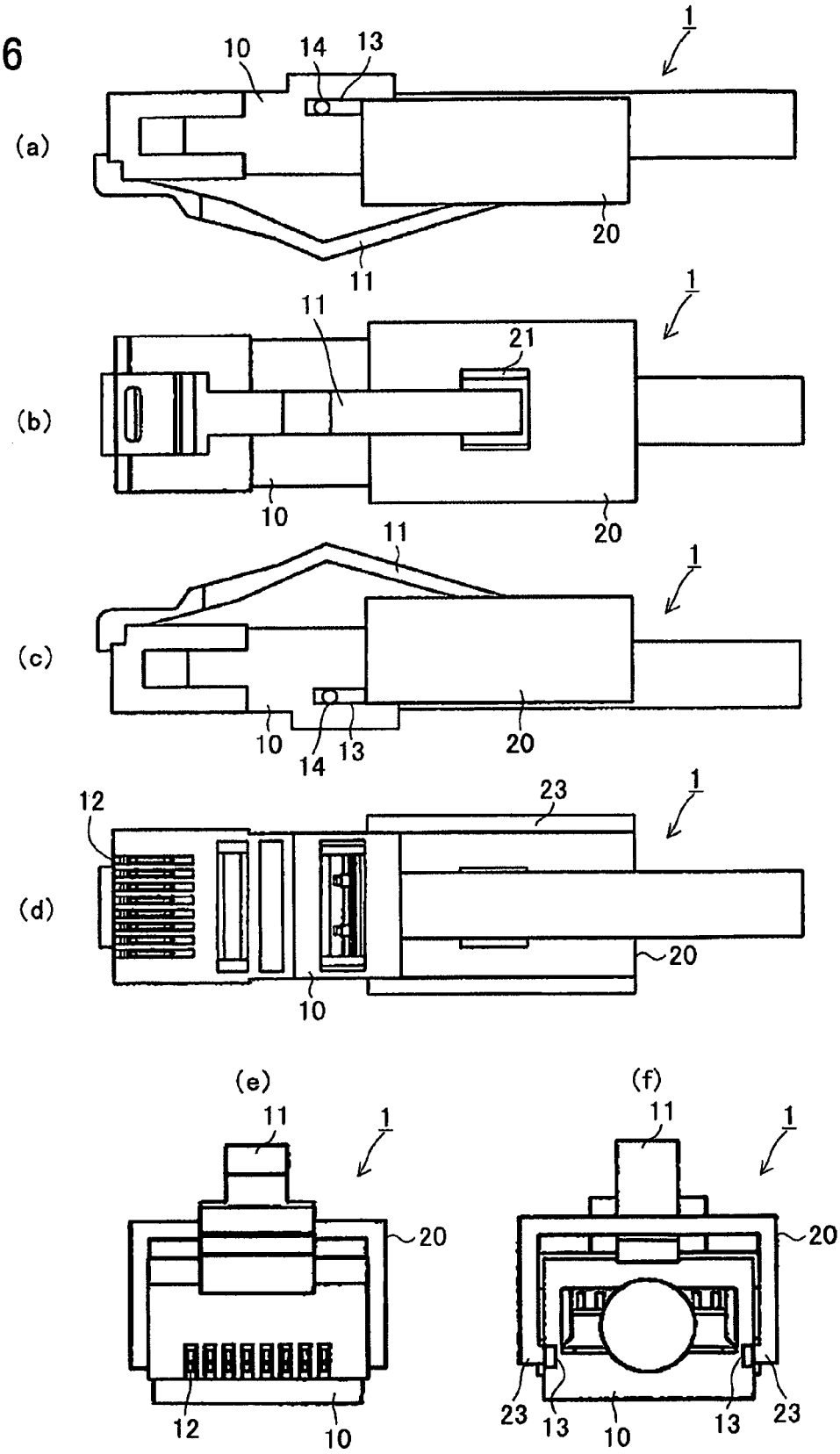
FIGS. 6(*a*) through 6(*f*) are drawings illustrating six sides of an exemplary LAN connector according to the first embodiment.

FIG. 5 is a perspective view of a LAN connector 1 formed by fitting together the modular plug 10 and the unlocking mechanism 20. FIGS. 6(*a*) through 6(*f*) are drawings illustrating six sides of the LAN connector 1. FIG. 6(*a*) is a left side view, FIG. 6(*b*) is a plan view, FIG. 6(*c*) is a right side view, FIG. 6(*d*) is a bottom view, FIG. 6(*e*) is a front view, and FIG. 6(*f*) is a rear view of the LAN connector 1. In FIGS. 5 through 6(*f*), the same reference number indicates the same component.

The modular plug 10 and the unlocking mechanism 20 are fitted together to form the LAN connector 1 by engaging the grooves 13 and the engaging parts 23 and inserting the hook-shaped end of the locking lever 11 into the opening 21.

Figure 7:
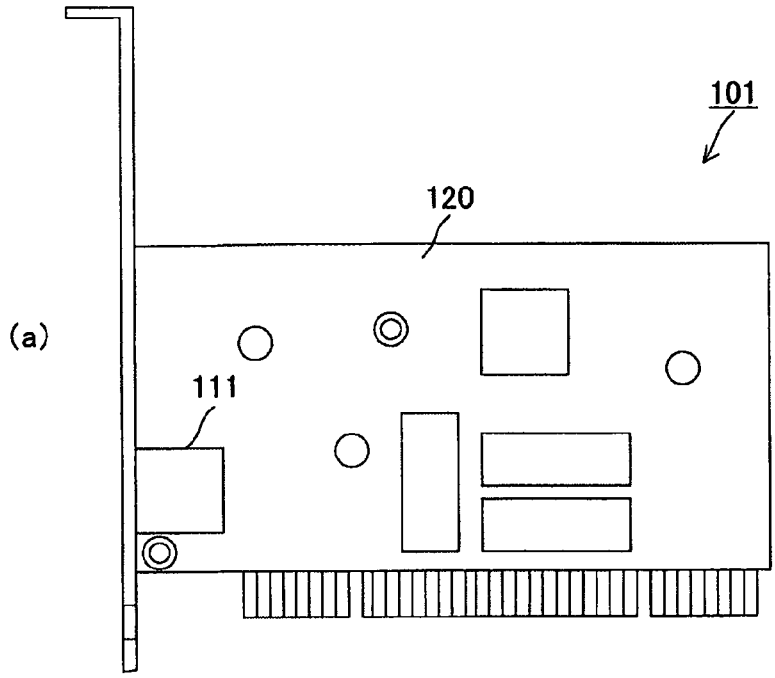
FIGS. 7(*a*) and 7(*b*) are a plan view and a front view of an exemplary LAN board according to an embodiment.
Figure 7:
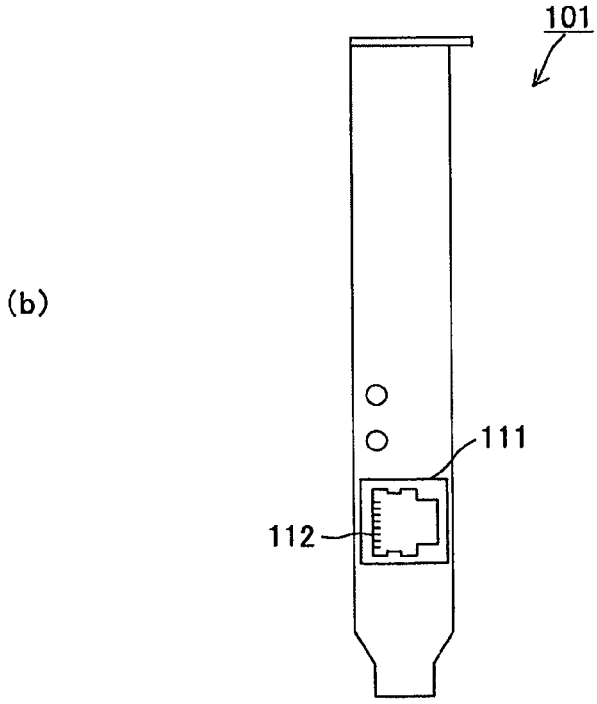

FIGS. 7(*a*) and 7(*b*) are a plan view and a front view of a LAN board 101.

The LAN board 101 has a configuration similar to that of a related-art LAN board. The LAN board 101 includes a housing 111 and connecting terminals 112 to be connected with the connecting terminals 12 of the modular plug 10. Grooves are formed in inner walls of the housing 111. When the modular plug 10 is inserted into the housing ill, the locking lever 11 is pressed down and slides along the grooves. Like a related-art LAN board, the LAN board 101 includes a communication control circuit board 120 for controlling LAN communications.

Figure 8:
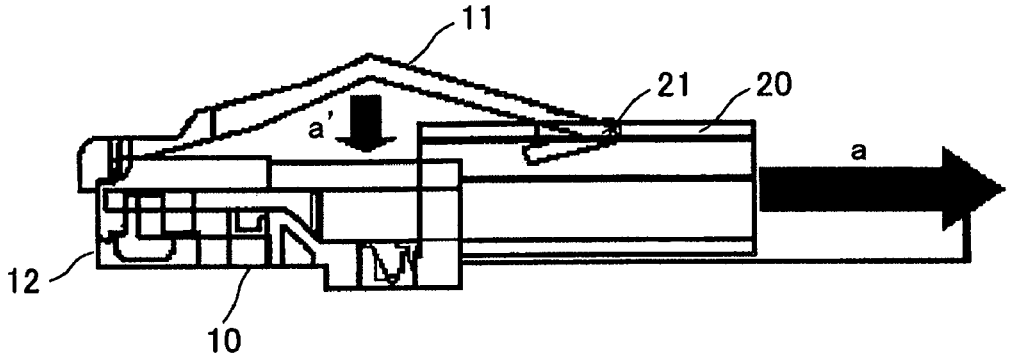
FIG. 8 is a drawing used to describe an exemplary method of unlocking a LAN connector according to the first embodiment.

An exemplary method of unplugging the LAN connector 1 from the LAN board 101 according to the first embodiment is described below with reference to FIG. 8. The method of plugging the LAN connector 1 into the housing 111 of the LAN board 101 is similar to a related-art method and therefore its descriptions are omitted here.

The user holds the unlocking mechanism 20 and moves or slides the unlocking mechanism 20 in an unplugging direction (the direction indicated by an arrow "a" in FIG. 8) along the grooves 13 engaging the engaging parts 23. As a result, the hook-shaped end of the locking lever 11 fits into the opening 21. When the user moves the unlocking mechanism 20 further in the unplugging direction, the bent angle of the middle part of the locking lever 11 becomes shallower (becomes more obtuse) and the bending point of the middle part moves downward in the direction indicated by an arrow a' in FIG. 8.

As a result, the locking lever 11 or the LAN connector 1 is unlocked. Thus, unlike a related-art configuration where a release clip is pressed down with fingers to unlock a LAN connector, the above configuration makes it possible to unlock the LAN connector 1 by just sliding the unlocking mechanism 20.

Accordingly, the above configuration makes it possible to easily unplug a LAN connector from a LAN board without using a tool even when the LAN connector is located in a narrow recess.

Also, the dowel housings 14 and the dowels 22 function as a position fixing mechanism for keeping the unlocking mechanism 20 in a fixed position. The position fixing mechanism prevents the unlocking mechanism 20 from being unintentionally moved and thereby prevents the LAN connector 1 from being accidentally unplugged.

<Second Embodiment>

Figure 9:
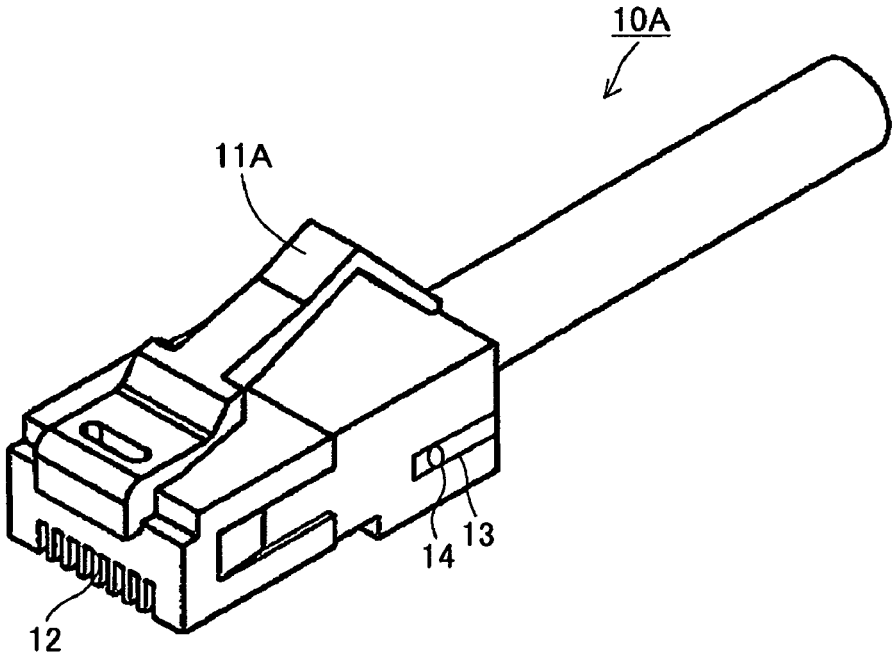
FIG. 9 is a perspective view of an exemplary modular plug according to a second embodiment.
Figure 10:
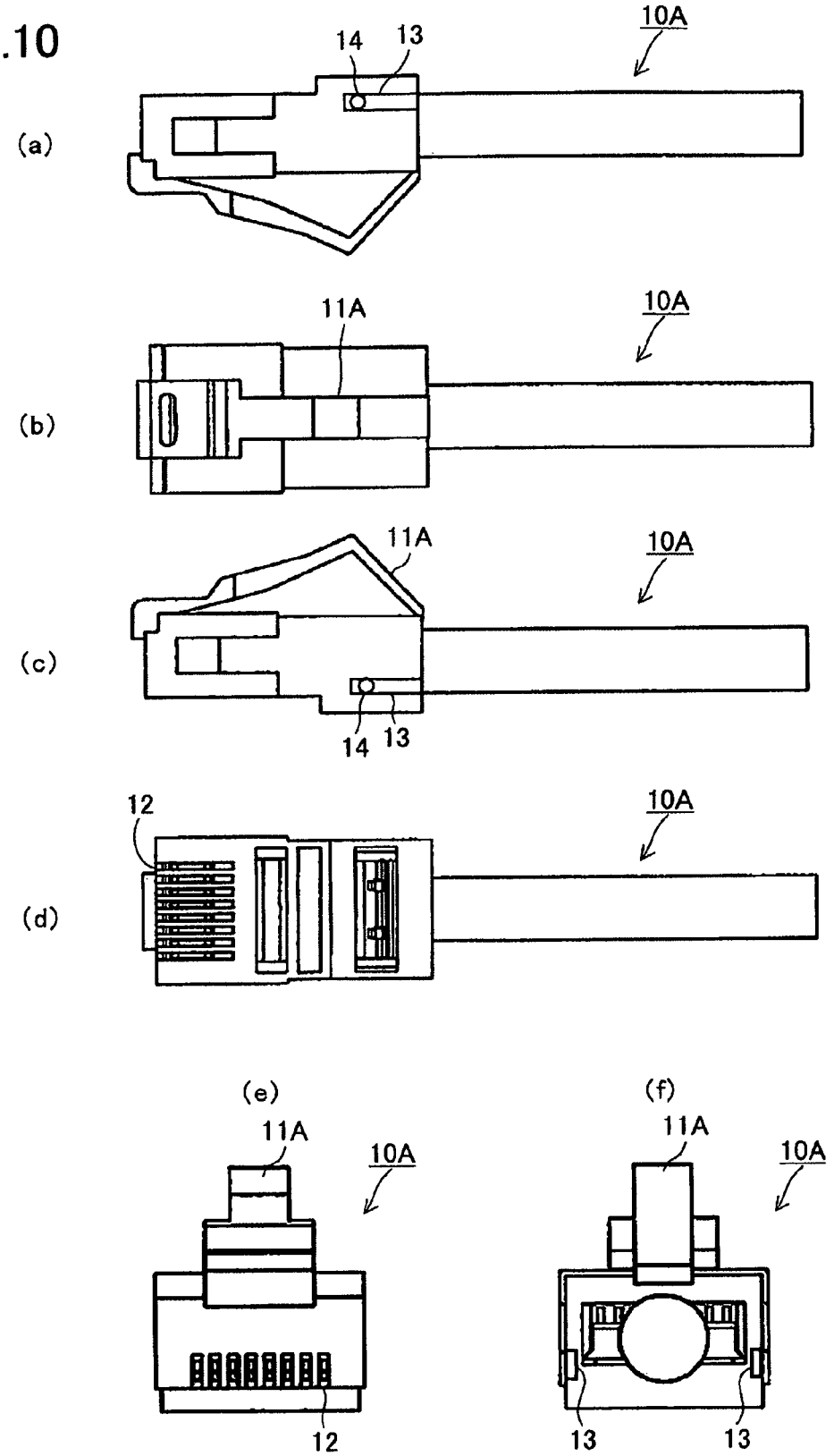
FIGS. 10(*a*) through 10(*f*) are drawings illustrating six sides of an exemplary modular plug according to the second embodiment.

FIG. 9 is a perspective view of an exemplary modular plug 10A according to a second embodiment. FIGS. 10(*a*) through 10(*f*) are drawings illustrating six sides of the modular plug 10A. FIG. 10(*a*) is a left side view, FIG. 10(*b*) is a plan view, FIG. 10(*c*) is a right side view, FIG. 10(*d*) is a bottom view, FIG. 10(*e*) is a front view, and FIG. 10(*f*) is a rear view of the modular plug 10A. In FIGS. 9 through 10(*f*), the same reference number indicates the same component.

The modular plug 10A (connector protrusion) includes a locking lever 11A, connecting terminals 12 (first connecting terminals), grooves 13, and dowel housings 14. The connecting terminals 12, the grooves 13, and the dowel housings 14 have substantially the same configurations and functions as those of the first embodiment and their descriptions are omitted here.

One end of the locking lever 11A is fixed to a surface (first surface) of the modular plug 10A and a middle part of the locking lever 11A is bent at an obtuse angle. The other end of the locking lever 11A is a free end that is positioned near the surface of the modular plug 10A or in contact with the surface of the modular plug 10A.

Similar to a release clip of a related-art LAN modular plug, the locking lever 11A has elasticity. When no force is applied to the locking lever 11A, the locking lever 11A is in a locking position where the modular plug 10A engages (or is interlocked with) a LAN board (e.g., the LAN board 101 of FIG. 7). When a downward force is applied to the middle part of the locking lever 11A, the modular plug 10A is unlocked and released from the LAN board.

Figure 11:
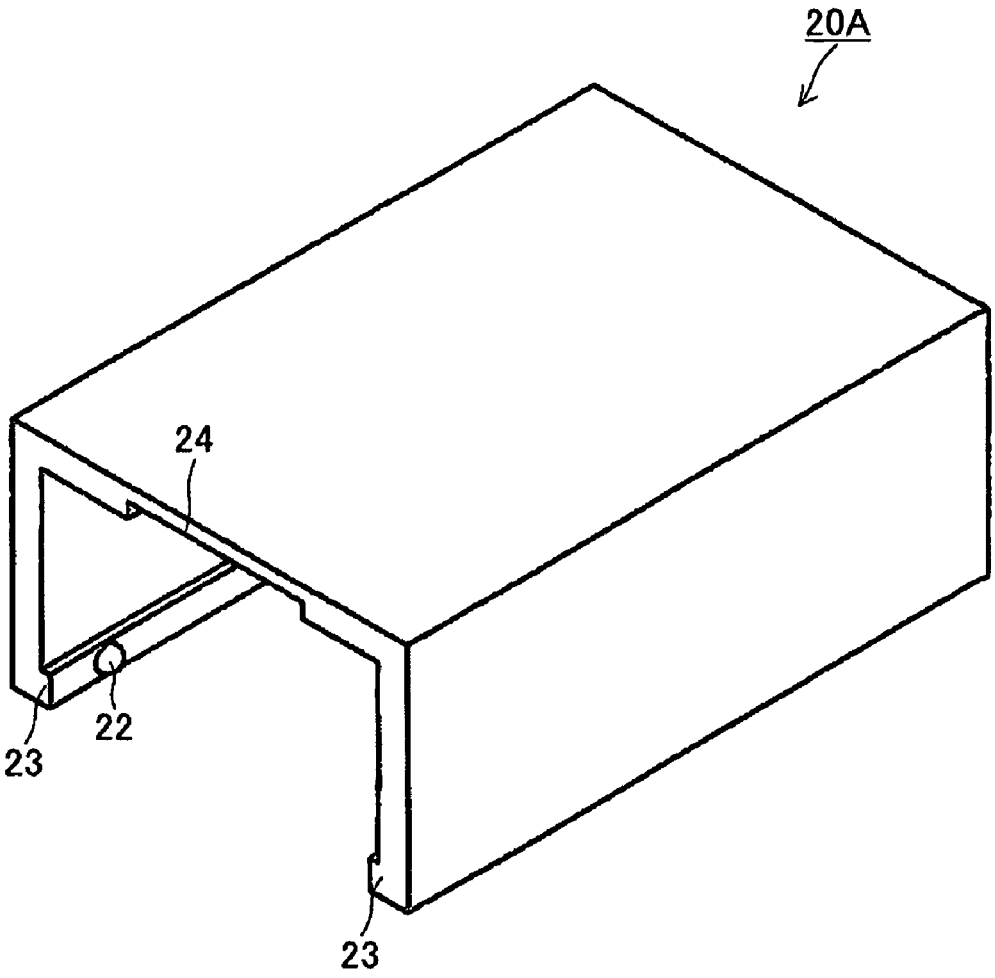
FIG. 11 is a perspective view of an exemplary unlocking mechanism according to the second embodiment.
Figure 12:
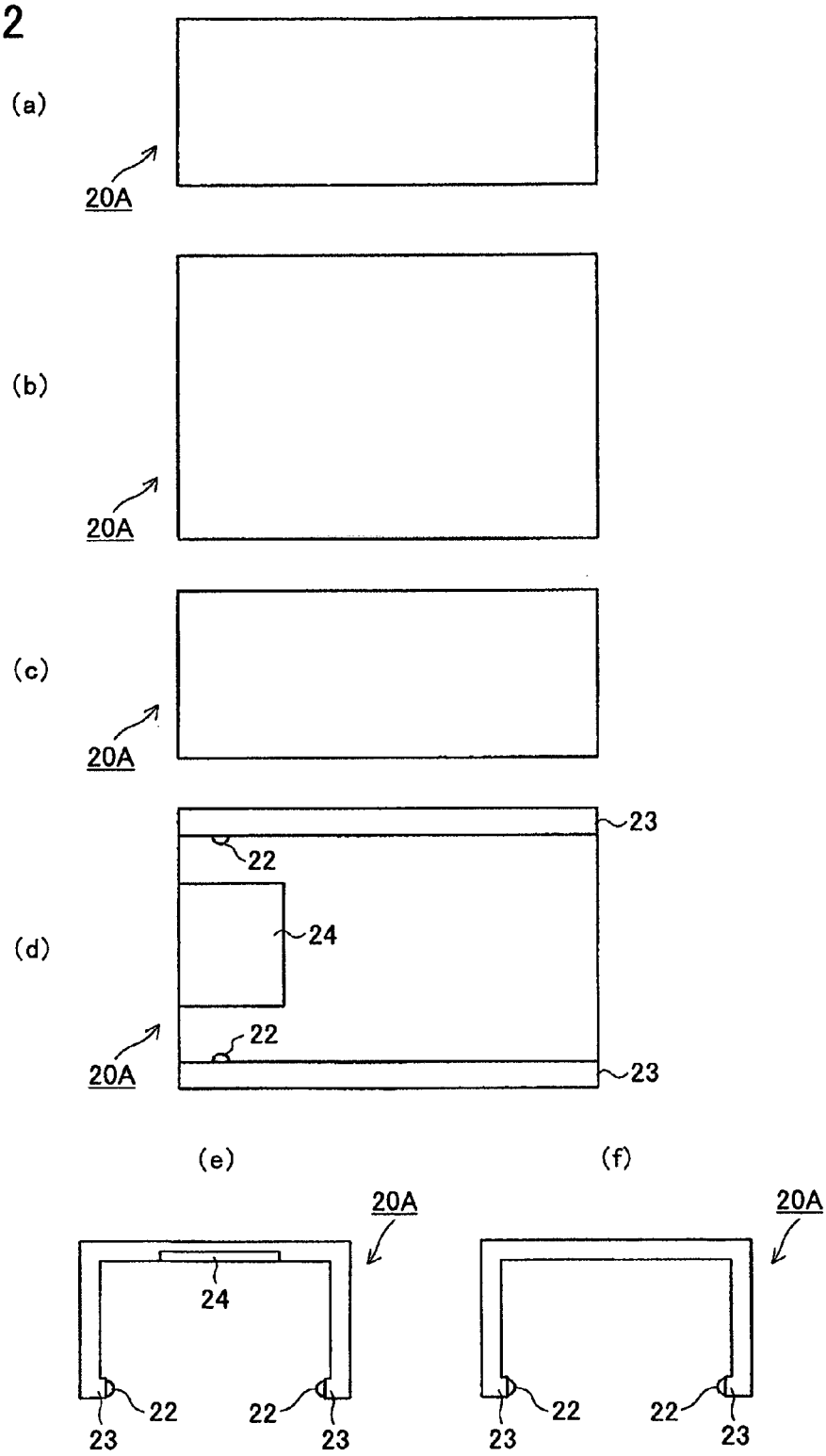
FIGS. 12(*a*) through 12(*f*) are drawings illustrating six sides of an exemplary unlocking mechanism according to the second embodiment.

FIG. 11 is a perspective view of an unlocking mechanism 20A according to the second embodiment. FIGS. 12(*a*) through 12(*f*) are drawings illustrating six sides of the unlocking mechanism 20A. FIG. 12(*a*) is a left side view, FIG. 12(*b*) is a plan view, FIG. 12(*c*) is a right side view, FIG. 12(*d*) is a bottom view, FIG. 12(*e*) is a front view, and FIG. 12(*f*) is a rear view of the unlocking mechanism 20A. In FIGS. 11 through 12(*f*), the same reference number indicates the same component.

Similar to the unlocking mechanism 20 of the first embodiment, the unlocking mechanism 20A (connector frame) has a U-shape surrounding the modular plug 10A. The unlocking mechanism 20A includes dowels 22, engaging parts 23, and a locking-lever sliding part 24.

The locking-lever sliding part 24 assists a part of the locking lever 11A including at least the free end to slide into a space between the LAN cable and the unlocking mechanism 20A (or a space surrounded by the unlocking mechanism 20A) when the LAN cable is unplugged from the LAN board.

The locking lever sliding part 24 is formed in an inner wall of the unlocking mechanism 20A that faces the surface of the modular plug 10A to which the locking lever 11A is fixed. In other words, the locking-lever sliding part 24 is a recess through which the locking lever 11A slides into the unlocking mechanism 20A and is a part of a wall of the unlocking mechanism 20A having a thickness that is less than the thickness of other walls. The locking-lever sliding part 24 increases the gap between the unlocking mechanism 20A and the LAN cable and makes it easier for the free end of the locking lever 11A to slide into the unlocking mechanism 20A.

The dowels 22 and the engaging parts 23 have substantially the same configurations and functions as those of the first embodiment and therefore their descriptions are omitted here.

Figure 13:
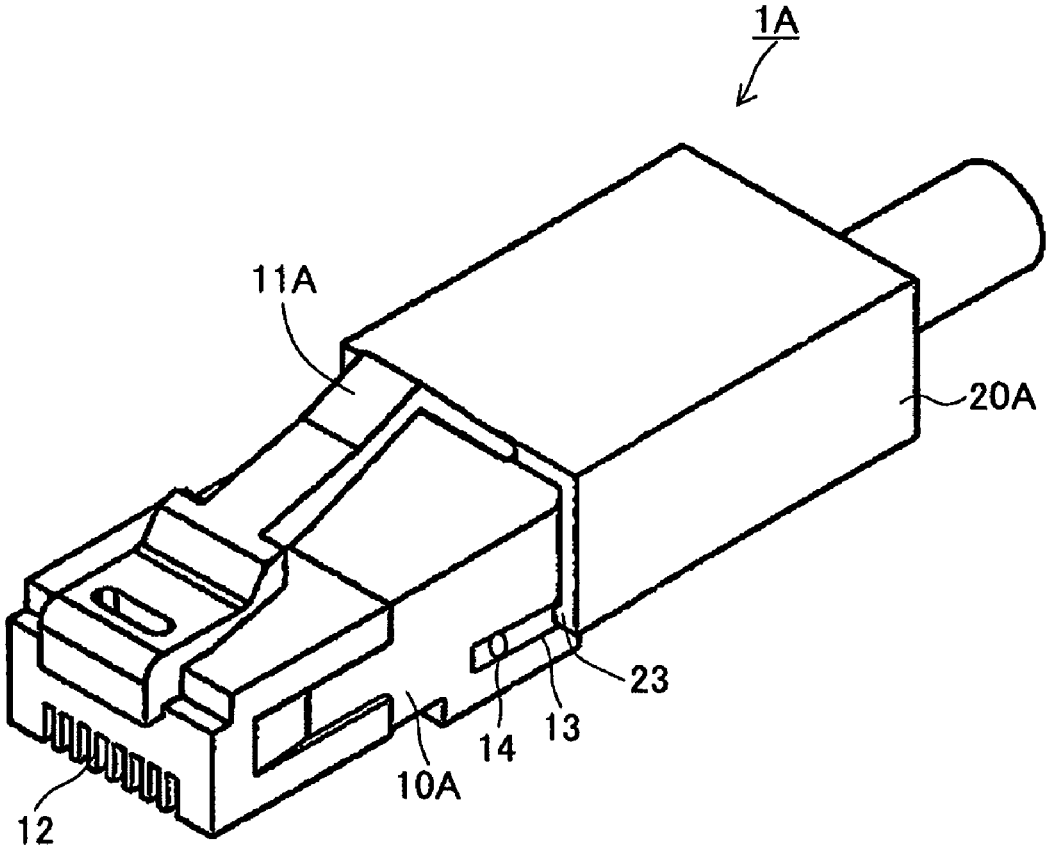
FIG. 13 is a perspective view of an exemplary LAN connector according to the second embodiment.
Figure 14:
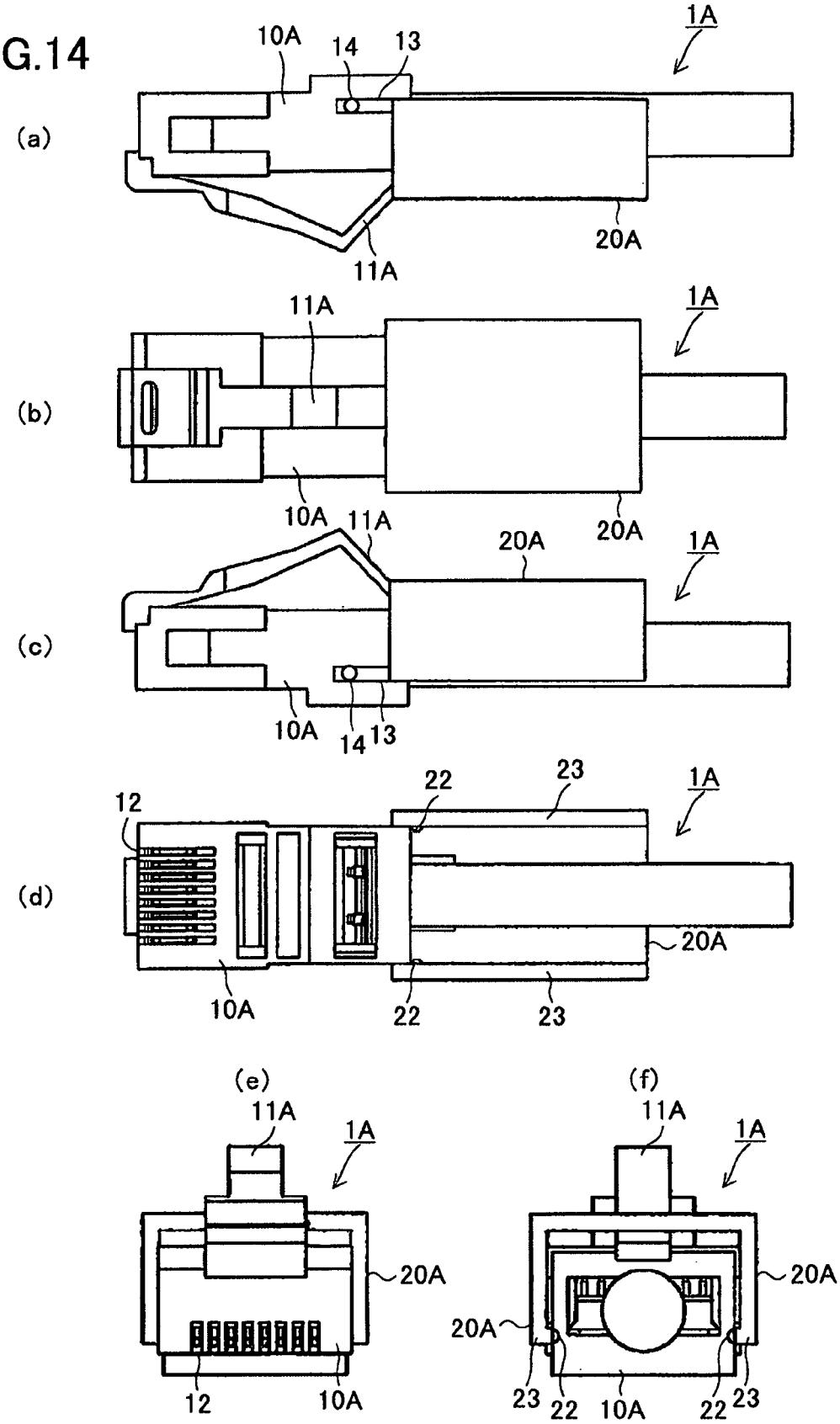
FIGS. 14(*a*) through 14(*f*) are drawings illustrating six sides of an exemplary LAN connector according to the second embodiment.

FIG. 13 is a perspective view of a LAN connector 1A formed by fitting together the modular plug 10A and the unlocking mechanism 20A. FIGS. 14(*a*) through 14(*f*) are drawings illustrating six sides of the LAN connector 1A. FIG. 14(*a*) is a left side view, FIG. 14(*b*) is a plan view, FIG. 14(*c*) is a right side view, FIG. 14(*d*) is a bottom view, FIG. 14(*e*) is a front view, and FIG. 14(*f*) is a rear view of the LAN connector 1A. In FIGS. 13 through 14(*f*), the same reference number indicates the same component.

The modular plug 10A and the unlocking mechanism 20A are fitted together to form the LAN connector 1A by engaging the grooves 13 and the engaging parts 23.

Figure 15:
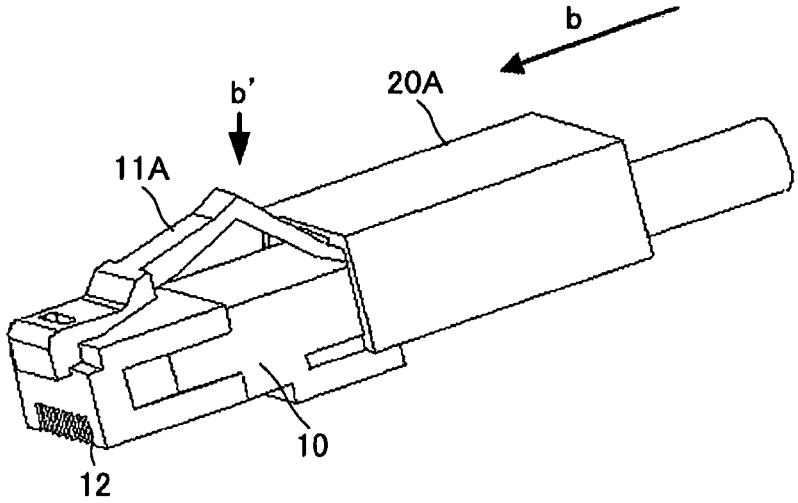
FIG. 15 is a drawing used to describe an exemplary method of unlocking a LAN connector according to the second embodiment.

An exemplary method of unplugging the LAN connector 1A from the LAN board (e.g., the LAN board 101 of FIG. 7) according to the second embodiment is described below with reference to FIG. 15. The method of plugging the LAN connector 1A into the housing 111 of the LAN board 101 is similar to a related-art method and therefore its descriptions are omitted here.

The user holds the unlocking mechanism 20A and moves or slides the unlocking mechanism 20A toward the modular plug 10A (in the direction indicated by an arrow "b" in FIG. 15) along the grooves 13 engaging the engaging parts 23. As a result, the free end of the locking lever 11A touches the locking-lever sliding part 24 of the unlocking mechanism 20A. When the unlocking mechanism 20A is moved further in the direction "b", the free end of the locking lever 11A slides into the space between the LAN cable and the inner wall of the unlocking mechanism 20A.

The inner wall of the unlocking mechanism 20A presses the locking lever 11A in the direction "b" and causes the locking lever 11A to slide further into the unlocking mechanism 20A. As the locking lever 11A slides into the unlocking mechanism 20A, the bent angle of the middle part of the locking lever 11A becomes shallower (becomes more obtuse) and the bending point of the middle part moves downward in the direction indicated by an arrow b' in FIG. 15.

As a result, the locking lever 11A or the LAN connector 1A is unlocked. Thus, unlike a related-art configuration where a release clip is pressed down with fingers to unlock a LAN connector, the above configuration makes it possible to unlock the LAN connector 1A by just sliding the unlocking mechanism 20A. Accordingly, the above configuration makes it possible to easily unplug a LAN connector from a LAN board even when the LAN connector is located in a narrow recess.

<Third Embodiment>

The unlocking mechanism 20A of the second embodiment may be normally separated from the modular plug 10A and attached to the modular plug 10A when unplugging the LAN connector 1A from the LAN board. With the configuration of the second embodiment, however, it is difficult to identify the position of the locking-lever sliding part 24 from the outside of the unlocking mechanism 20A when fitting together the unlocking mechanism 20A and the modular plug 10A.

Figure 16:
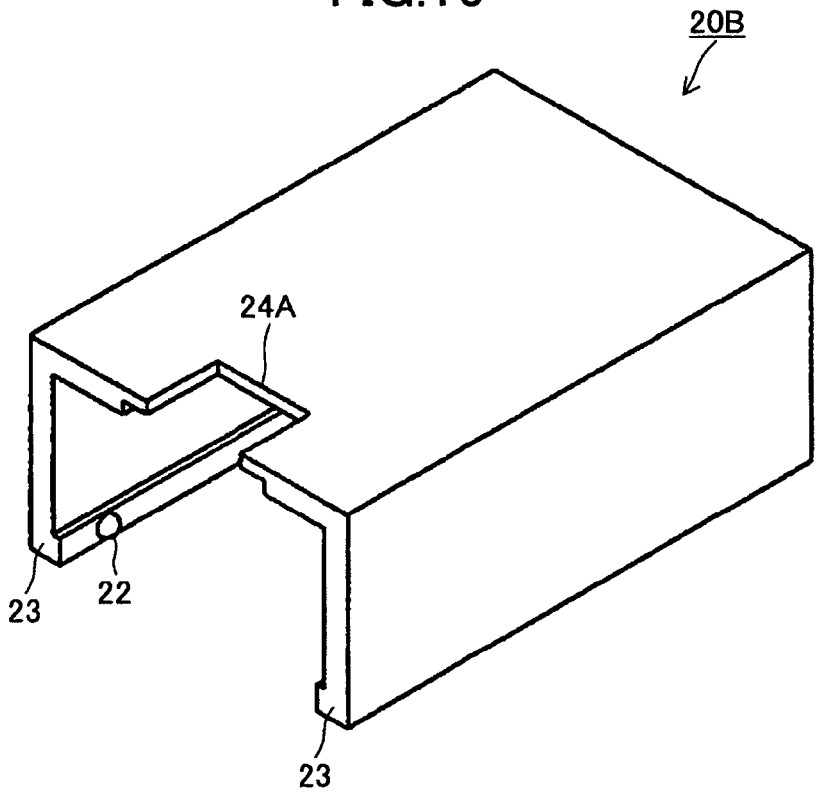
FIG. 16 is a perspective view of an exemplary unlocking mechanism according to a third embodiment.
Figure 17:
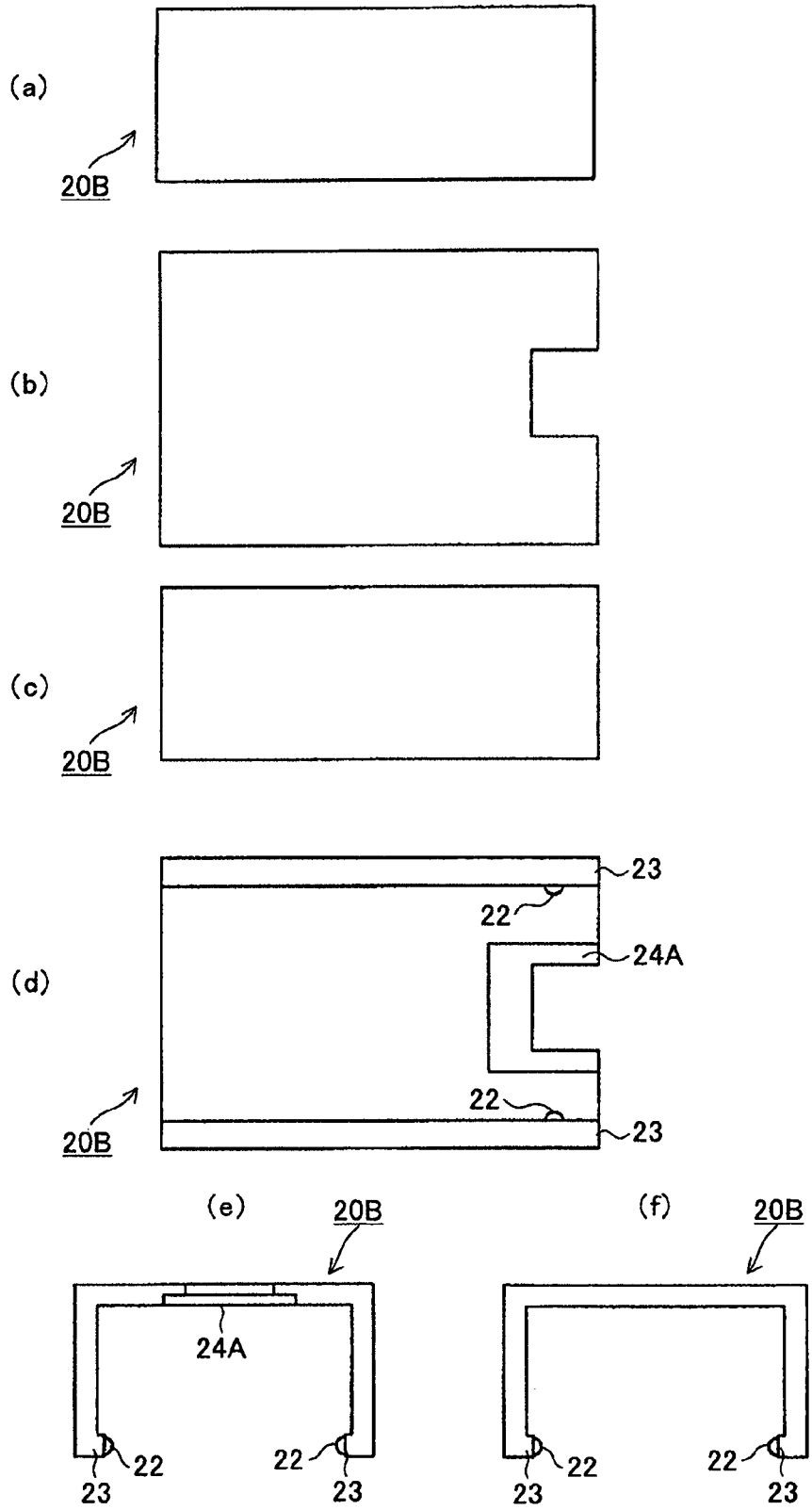
FIGS. 17(*a*) through 17(*f*) are drawings illustrating six sides of an exemplary unlocking mechanism according to the third embodiment.

In a third embodiment, the shape of the locking-lever sliding part 24 of the unlocking mechanism 20A is changed to solve this problem. FIG. 16 is a perspective view of an unlocking mechanism 20B according to the third embodiment. FIGS. 17(*a*) through 17(*f*) are drawings illustrating six sides of the unlocking mechanism 20B. FIG. 17(*a*) is a left side view, FIG. 17(*b*) is a plan view, FIG. 17(*c*) is a right side view, FIG. 17(*d*) is a bottom view, FIG. 17(*e*) is a front view, and FIG. 17(*f*) is a rear view of the unlocking mechanism 20B. In FIGS. 16 through 17(*f*), the same reference number indicates the same component.

The unlocking mechanism 20B includes dowels 22, engaging parts 23, and a locking-lever sliding part 24A. The dowels 22 and the engaging parts 23 have substantially the same configurations and functions as those of the first and second embodiments and therefore their descriptions are omitted here.

Different from the locking-lever sliding part 24 of the second embodiment, the locking-lever sliding part 24A is open to the outside via the upper surface of the unlocking mechanism 20B so that the locking-lever sliding part 24A can be identified from the outside of the unlocking mechanism 20B.

Figure 18:
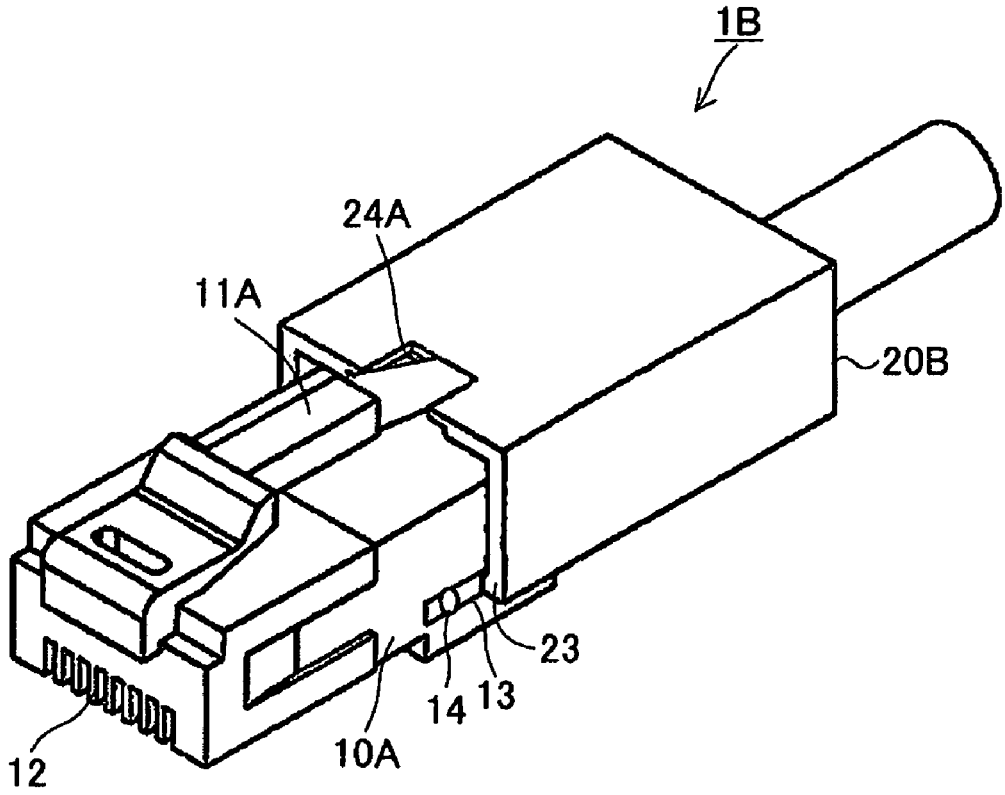
FIG. 18 is a perspective view of an exemplary LAN connector according to the third embodiment.

FIG. 18 is a perspective view of a LAN connector 1B according to the third embodiment. The LAN connector 1B includes the modular plug 10A of the second embodiment and the unlocking mechanism 20B described above. The method of unplugging the LAN connector 1B is substantially the same as that of the second embodiment and therefore its descriptions are omitted here.

<Fourth Embodiment>

With the LAN connector 1 of the first embodiment, one end of the locking lever 11 fits into the opening 21 of the unlocking mechanism 20 and the locking lever 11 and the unlocking mechanism 20 are thereby connected to each other. When the unlocking mechanism 20 is moved in the unplugging direction, the locking lever 11 is unlocked and the modular plug 10 is unplugged from the LAN board.

This indicates that it is possible to unlock a locking lever by moving an unlocking mechanism as in the first embodiment as long as the locking lever and the unlocking mechanism are connected to each other. In a fourth embodiment, other exemplary configurations for connecting the unlocking mechanism and the locking lever are described with reference to FIGS. 19(*a*) through 21(*c*).

Figure 19:
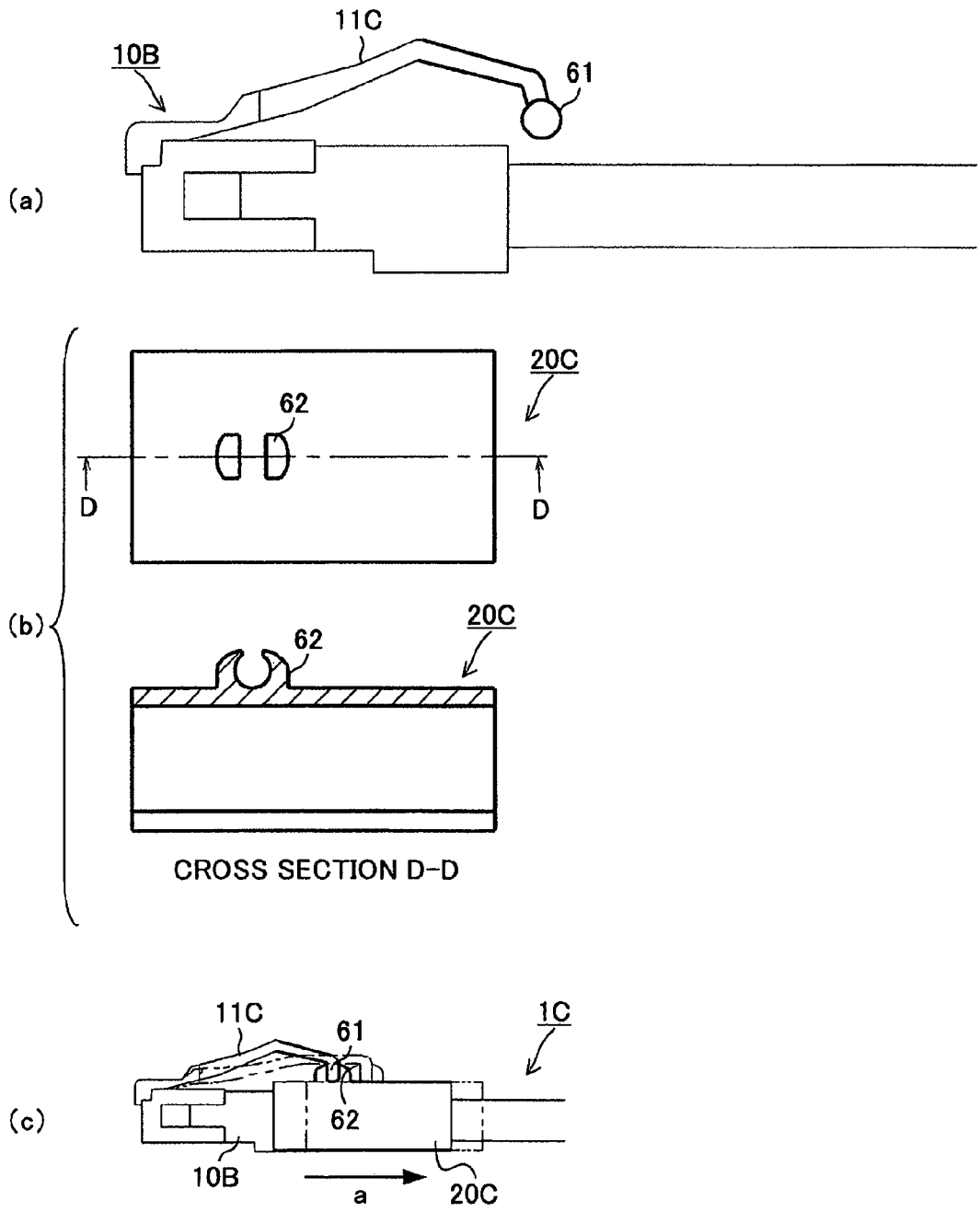
FIGS. 19(*a*) through 19(*c*) are drawings (1) illustrating examples of a modular plug, an unlocking mechanism, and a LAN connector according to a fourth embodiment.

A first exemplary configuration is described below with reference to FIGS. 19(*a*) through 19(*c*). FIG. 19(*a*) is a side view of a modular plug 10B, FIG. 19(*b*) is a plan view and a cross-sectional view of an unlocking mechanism 20C, and FIG. 19(*c*) is a side view of a LAN connector 1C formed by connecting the modular plug 10B and the unlocking mechanism 20C.

The modular plug 10B includes a locking lever 11C having a spherical end 61 (see FIG. 19(*a*)). The unlocking mechanism 20C includes an end receiving part 62 on the upper surface which is to be fitted together with the end 61 of the locking lever 11C (see FIG. 19(*b*)).

The modular plug 10B and the unlocking mechanism 20C are connected to each other by fitting the end 61 of the locking lever 11C into the end receiving part 62 of the unlocking mechanism 20C (see FIG. 19(*c*)). As in the first embodiment, when the unlocking mechanism 20C is moved in an unplugging direction indicated by an arrow "a" in FIG. 19(*c*), the LAN connector 1C is unlocked and released from the LAN board.

Figure 20:
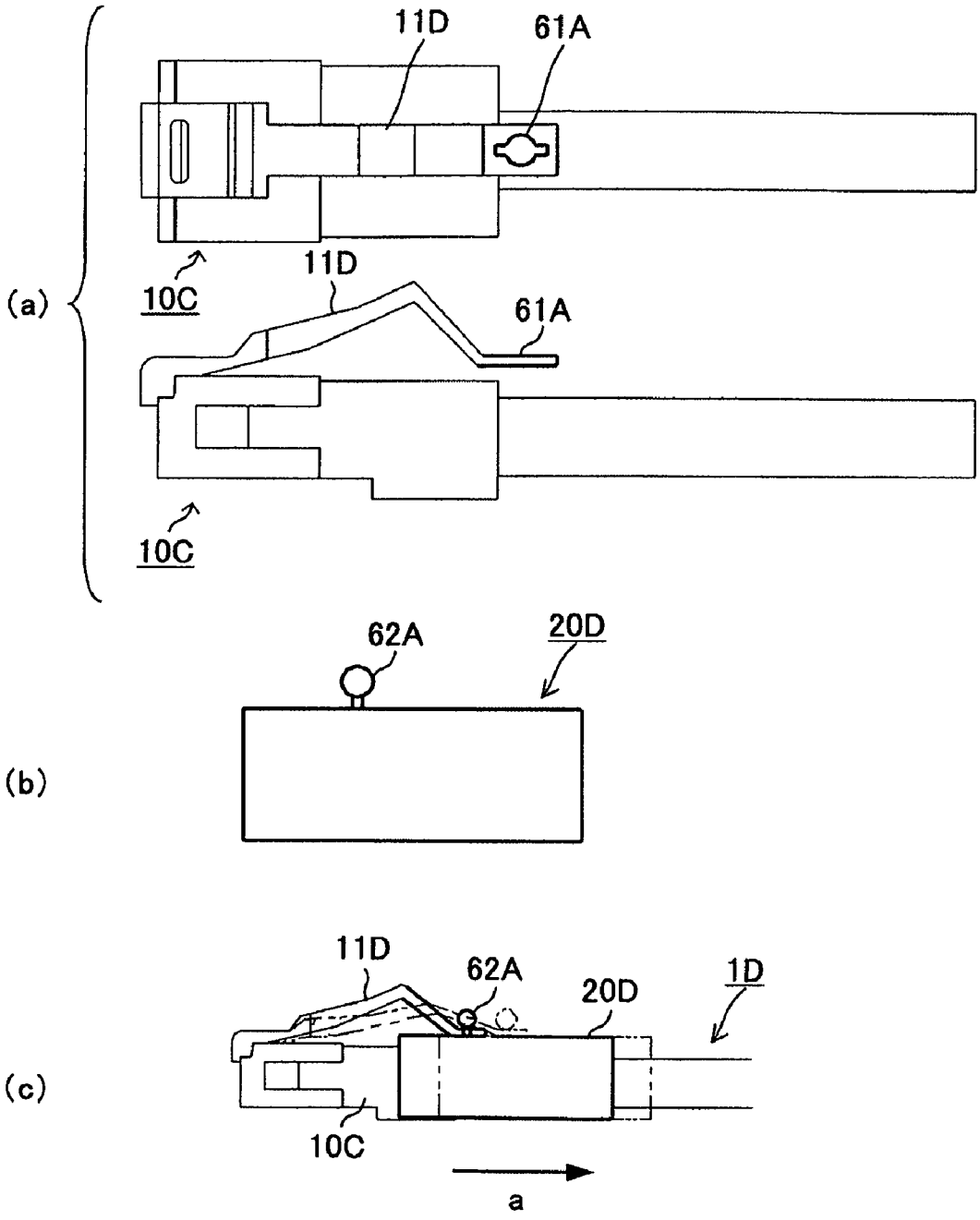
FIGS. 20(*a*) through 20(*c*) are drawings (2) illustrating examples of a modular plug, an unlocking mechanism, and a LAN connector according to the fourth embodiment.

A second exemplary configuration is described below with reference to FIGS. 20(*a*) through 20(*c*). FIG. 20(*a*) is a plan view and a side view of a modular plug 10C, FIG. 20(*b*) is a side view of an unlocking mechanism 20D, and FIG. 20(*c*) is a side view of a LAN connector 1D formed by connecting the modular plug 10C and the unlocking mechanism 20D.

The modular plug 10C includes a locking lever 11D. A hole 61A to be fitted together with a spherical protrusion 62A is formed in one end of the locking lever 11D (see FIG. 20(*a*)). The unlocking mechanism 20D includes the spherical protrusion 62A on the upper surface which is fitted into the hole 61A of the locking lever 11D (see FIG. 20(*b*)).

The modular plug 10C and the unlocking mechanism 20D are connected to each other by fitting the spherical protrusion 62A of the unlocking mechanism 20D into the hole 61A of the locking lever 11D (see FIG. 20(*c*)). As in the first embodiment, when the unlocking mechanism 20D is moved in an unplugging direction indicated by an arrow "a" in FIG. 20(*c*), the LAN connector 1D is unlocked and released from the LAN board.

Figure 21:
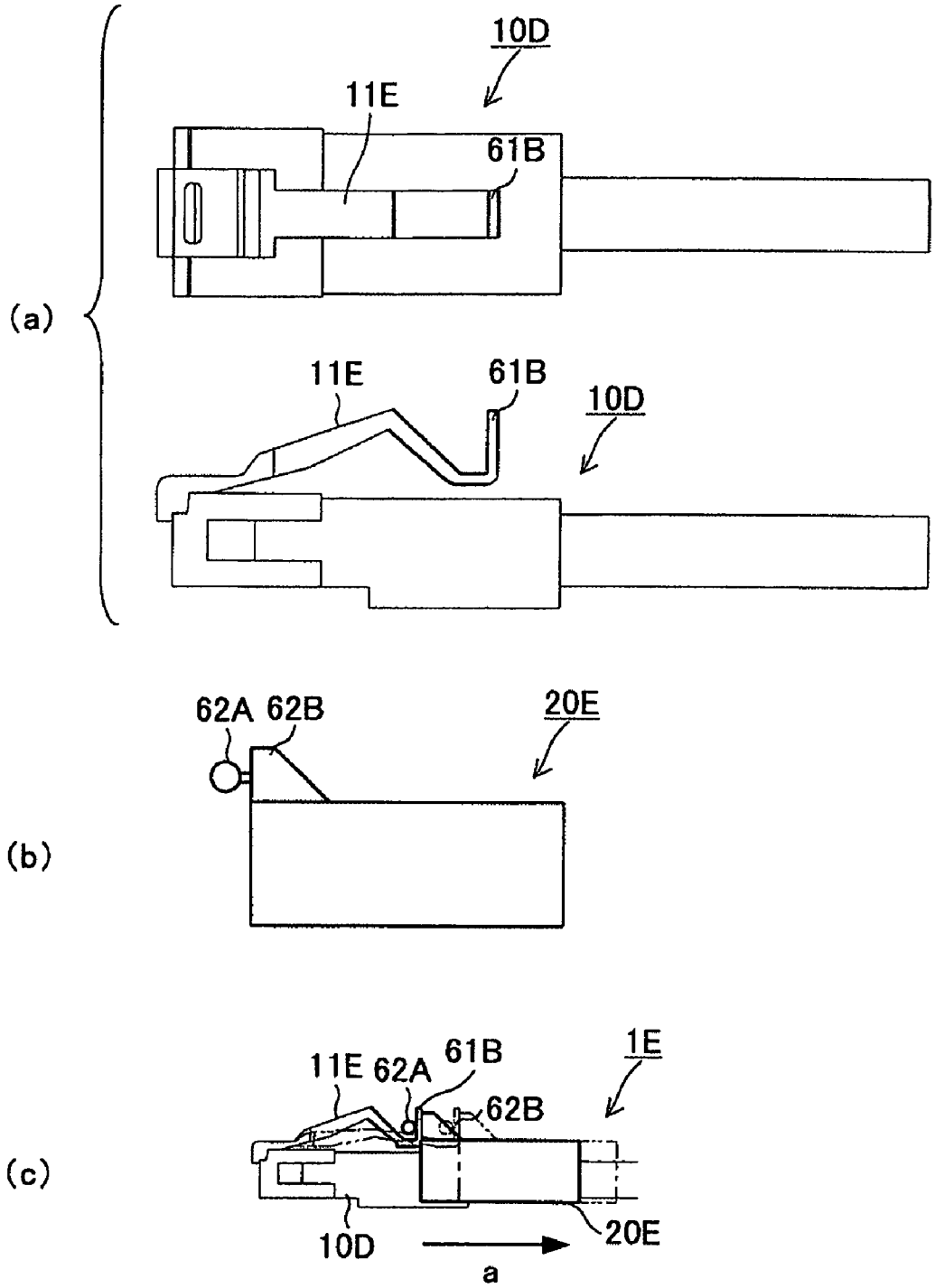
FIGS. 21(*a*) through 21(*c*) are drawings (3) illustrating examples of a modular plug, an unlocking mechanism, and a LAN connector according to the fourth embodiment.
Figure 22:
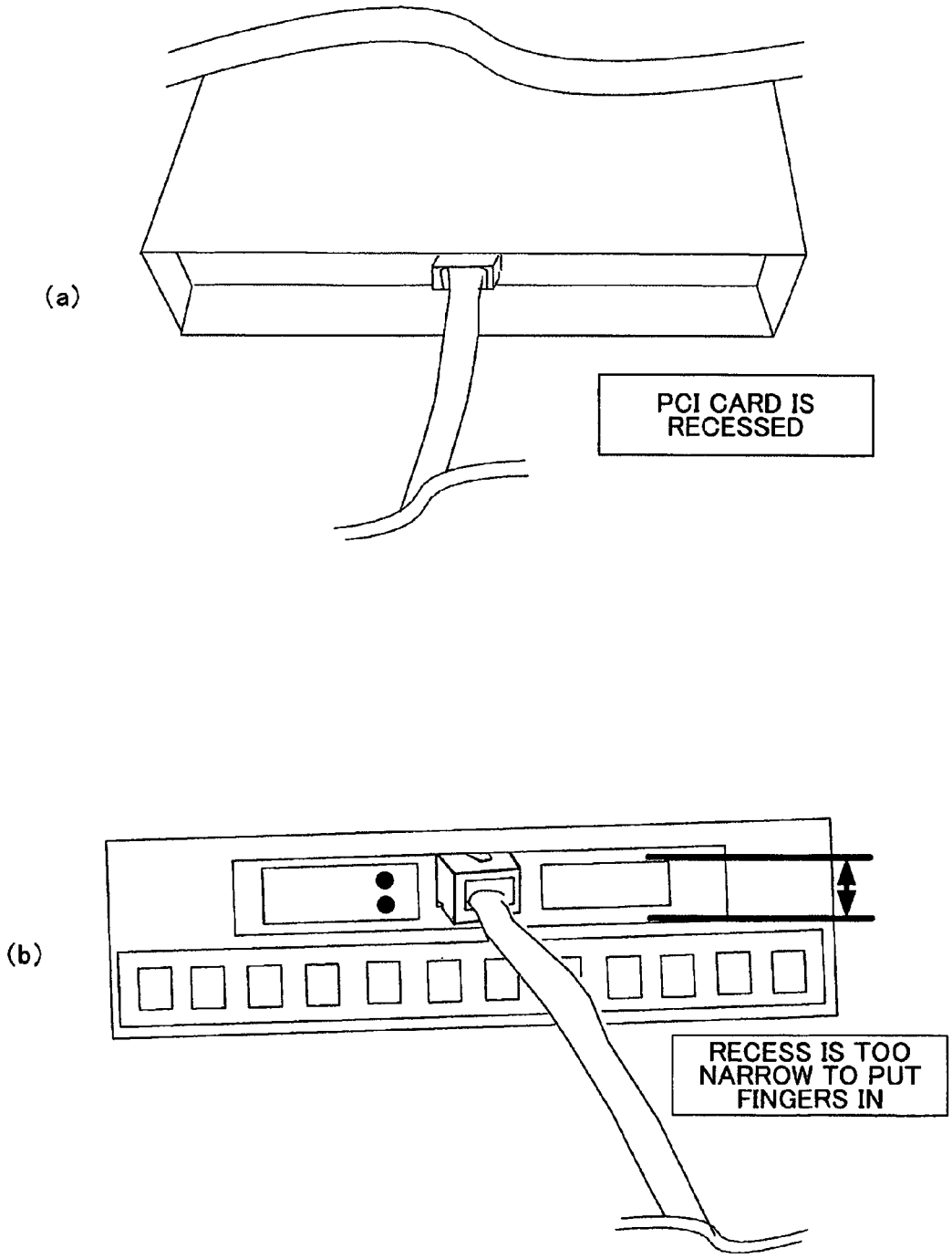
FIGS. 22(*a*) and 22(*b*) are drawings (1) used to describe problems in a related-art LAN connector.
Figure 23:
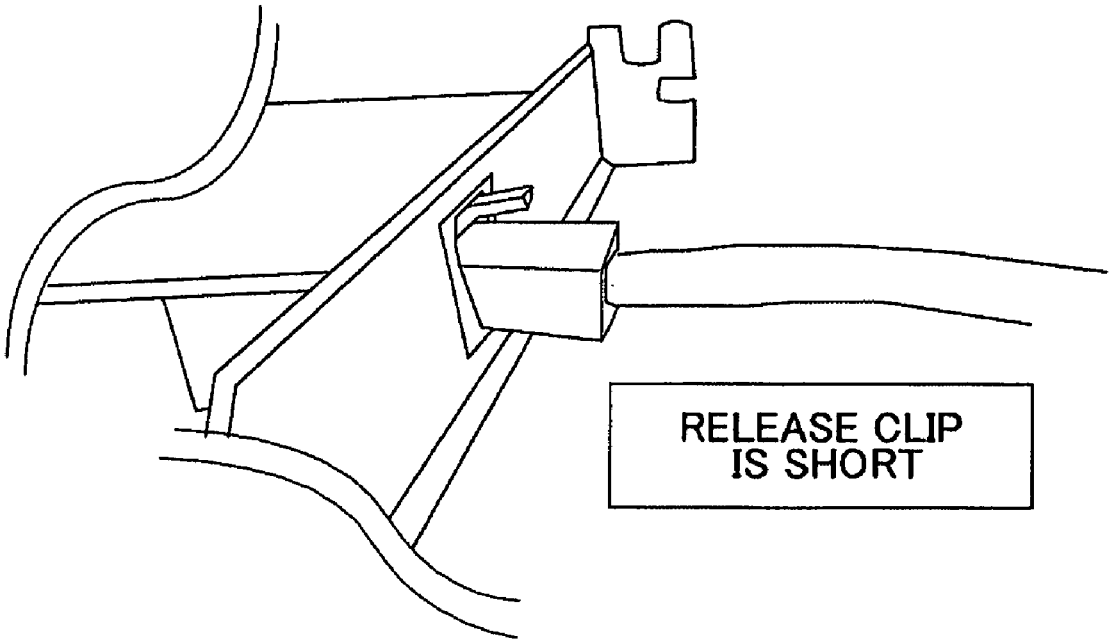
FIG. 23 is a drawing (2) used to describe problems in a related-art LAN connector.

A third exemplary configuration is described below with reference to FIGS. 21(*a*) through 21(*c*). FIG. 21(*a*) is a plan view and a side view of a modular plug 10D, FIG. 21(*b*) is a side view of an unlocking mechanism 20E, and FIG. 21(*c*) is a side view of a LAN connector 1E formed by connecting the modular plug 10D and the unlocking mechanism 20E.

The modular plug 10D includes a locking lever 11E having an end 61B that is bent to become orthogonal to the upper surface of the modular plug 10D (see FIG. 21(*a*)). A hole 61A as shown in FIG. 20(*a*) is formed in the end 61B. The unlocking mechanism 20E includes a connecting part 62B including a spherical protrusion 62A as shown in FIG. 20(*b*) and a trapezoidal support part supporting the spherical protrusion 62A in a horizontal position (see FIG. 21(*b*)).

The modular plug 10D and the unlocking mechanism 20E are connected to each other by fitting together the end 61B of the locking lever 11D and the connecting part 62B of the unlocking mechanism 20E (see FIG. 21(*c*)). As in the first embodiment, when the unlocking mechanism 20E is moved in an unplugging direction indicated by an arrow "a" in FIG. 21(*c*), the LAN connector 1E is unlocked and released from the LAN board.

In the present application, a connecting unit may indicate a combination of the LAN connector 1 of the first embodiment, the housing 111, and the connecting terminals 112, or a combination of the LAN connector 1A of the second embodiment, the housing 111, and the connecting terminals 112.

Also, a connecting unit may indicate a combination of the LAN connector 1B of the third embodiment, the housing 111, and the connecting terminals 112. Further, a connecting unit may indicate a combination of the LAN connector 1C, 1D, or 1E of the fourth embodiment, the housing 111, and the connecting terminals 112.

In the present application, an electronic device may indicate a combination of the LAN connector 1 of the first embodiment, the housing 111, the connecting terminals 112, and the communication control circuit board 120, or a combination of the LAN connector 1A of the second embodiment, the housing 111, the connecting terminals 112, and the communication control circuit board 120.

Also, an electronic device may indicate a combination of the LAN connector 1B of the third embodiment, the housing 111, the connecting terminals 112, and the communication control circuit board 120. Further, an electronic device may indicate a combination of the LAN connector 1C, 1D, or 1E of the fourth embodiment, the housing 111, the connecting terminals 112, and the communication control circuit board 120.

INDUSTRIAL APPLICABILITY

As described above, an aspect of the embodiments makes it possible to easily unplug a LAN connector from a LAN board without using a tool even when the LAN board is located in a recess, and thereby makes it possible to improve the reliability of a LAN connector and to reduce the workload.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A connector, comprising:

a connector protrusion to be inserted into a connector socket, the connector protrusion including a locking lever provided on a first surface and a connecting terminal provided on a second surface opposing the first surface or on a front surface; and a connector frame that surrounds the connector protrusion and has an opening in a surface opposing the first surface of the connector protrusion, wherein the connector frame is configured such that when the connector frame is moved in a direction opposite to a direction where the connector protrusion is inserted while the connector protrusion is in the connector socket, an end of the locking lever fits into the opening and the locking lever is unlocked.

2. The connector as claimed in claim 1, wherein the connector protrusion further includes a first groove formed in a first side surface of the connector protrusion and a second groove formed in a second side surface opposing the first side surface; and the connector frame further includes a first engaging part configured to engage and slide along the first groove and a second engaging part configured to engage and slide along the second groove.

3. The connector as claimed in claim 2, wherein a cross section of the connector frame has a U-like shape.

4. A connecting unit, comprising:

a connector protrusion including a locking lever provided on a first surface and a first connecting terminal provided on a second surface opposing the first surface or on a front surface;

a connector socket including a second connecting terminal to be connected with the first connecting terminal and a housing having a groove formed in an inner wall so that the locking lever is pressed down and slides along the groove when the connector protrusion is inserted into the connector socket; and a connector frame that surrounds the connector protrusion and has an opening in a surface opposing the first surface of the connector protrusion, wherein the connector frame is configured such that when the connector frame is moved in a direction opposite to a direction where the connector protrusion is inserted while the connector protrusion is in the connector socket, an end of the locking lever fits into the opening and the locking lever is unlocked.

5. A connector, comprising:

a connector protrusion to be inserted into a connector socket, the connector protrusion including a locking lever provided on a first surface and a connecting terminal provided on a second surface opposing the first surface or on a front surface; and a connector frame that surrounds the connector protrusion, wherein the connector frame is configured such that when the connector frame is pressed in a direction toward the connector protrusion while the connector protrusion is in the connector socket, an end of the locking lever slides into a space surrounded by the connector frame and the locking lever is unlocked.

6. The connector as claimed in claim 5, wherein the connector protrusion further includes a first groove formed in a first side surface of the connector protrusion and a second groove formed in a second side surface opposing the first side surface; and the connector frame further includes a first engaging part configured to engage and slide along the first groove and a second engaging part configured to engage and slide along the second groove.

7. The connector as claimed in claim 6, wherein a cross section of the connector frame has a U-like shape.

* * * * *